United States Patent [19]

Ollinger

[11] 4,145,859

[45] Mar. 27, 1979

[54] SPLICE FOR METAL FURRING STRIP

[75] Inventor: James C. Ollinger, Lancaster, Pa.

[73] Assignee: Armstrong Cork Company, Lancaster, Pa.

[21] Appl. No.: 820,048

[22] Filed: Jul. 29, 1977

[51] Int. Cl.[2] ..... E04B 5/55

[52] U.S. Cl. ..... 52/483; 52/726; 52/735

[58] Field of Search ..... 52/726, 238, 363, 361, 52/362, 484, 483; 403/363, 393

[56] References Cited

U.S. PATENT DOCUMENTS

| | | | |
|---|---|---|---|
| 1,675,226 | 6/1928 | Munroe et al. | 52/363 |
| 2,190,004 | 2/1940 | Baker | 52/726 |
| 2,741,344 | 4/1956 | Herr | 52/726 |
| 3,461,638 | 8/1969 | Balinski | 52/238 |
| 3,925,955 | 12/1975 | Becht | 52/376 |
| 4,001,993 | 1/1977 | Daniels | 52/376 |

*Primary Examiner*—James L. Ridgill, Jr.

[57] ABSTRACT

The invention is primarily directed towards a splice for fastening together metal furring strips which are mounted to a ceiling. Ceiling tiles are placed adjacent the metal furring strips and staples are driven through the ceiling tiles into the metal furring strips to mount the ceiling tiles in position.

4 Claims, 3 Drawing Figures

SPLICE FOR METAL FURRING STRIP

BACKGROUND OF THE INVENTION

1. Field of the Invention

The invention is directed to a building structure and, more particularly, to a furring strip splice which is used to mount building components in position.

2. Description of the Prior Art

U.S. Pat. No. 1,976,577 discloses a metal furring strip structure which is used to hold ceiling components in position. The metal furring strip structure is fastened to the overlying structural ceiling, and bolts or screws are utilized to fasten the ceiling panel support members to the furring strip structure. The support members in turn hold the ceiling panels in position.

U.S. Pat. No. 3,477,187 discloses a metal furring strip structure. Building components are mounted to the metal furring strip structure by the use of self-drilling and self-tapping screws which are driven through the building component into a raised portion of the furring strip structure.

U.S. Pat. No. 2,924,856 discloses another ceiling mounting structure which could be considered a furring strip structure. Actually, the mounting structure is called a runner member in the art and is provided with a plurality of slots. Mounting screws pass through ceiling components and are screwed into the slot structures of the runner member for the purpose of holding the ceiling tiles in position.

Finally, U.S. Pat. No. 2,578,614 discloses the use of a wood furring strip structure used in conjunction with a metal furring strip structure. The assembly is held in position by nails which pierce both the wood and metal structures forming the furring strip elements.

The invention herein is primarily directed to a splice joint for the metal strip structures. A problem was encountered in attempting to drive staples through the metal furring strip within 3" of either end of the furring strip. The channel end will collapse without letting the staples penetrate the strip. The invention consists of a special splice for two furring strips. The splice not only joined the furring strips together but strengthened the ends of the furring strips.

SUMMARY OF THE INVENTION

The invention is directed to a splice for a metal furring strip. The metal furring strip is formed with a thin center section and two side wall sections extending from either side of the center section in a direction substantially perpendicular from the plane of the center section. Each of the side walls then have a flange member extending therefrom substantially perpendicular thereto. The flanges are in the same plane, and this plane is parallel to the plane containing the center section of the furring strip. The ends of the flanges are provided with tabs and slots. The tabs on one flange engage the slots on the other flange to lock together these two flanges. In addition, each center section of the metal furring strips has a support means which extends perpendicular to the center section and bridges the space between the plane containing the center section of the furring strip and the plane containing the flanges of the furring strip.

The furring strips with their splices are mounted adjacent a structural ceiling and ceiling tiles or ceiling boards are fastened thereto by staples which pass through the ceiling tiles and penetrate the thin center section of the metal furring strip.

DESCRIPTION OF THE PREFERRED EMBODIMENT

Figure 1:
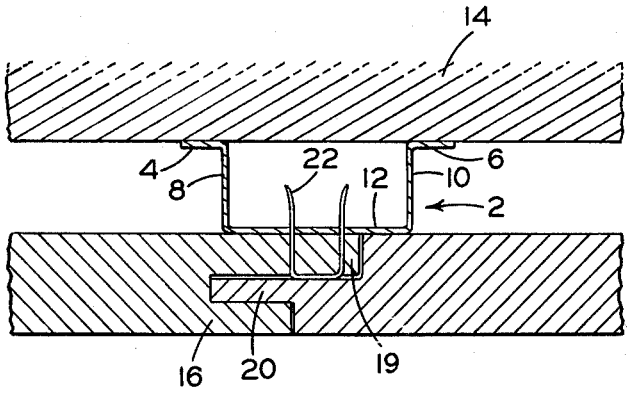
FIG. 1 is a cross-sectional view of the furring strip in use.

Referring to FIG. 1, there is shown the metal furring strip 2 in position fastened to an overlying ceiling structure 14. The flanges 4 and 6 are placed up against the bottom surface of the overlying ceiling structure 14, and appropriate fastening means hold the metal furring top surface of the metal flange facing downward and space from the ceiling structure 14. The ceiling boards 16 are placed up against the metal furring strip 2. A ceiling board 16 is placed in position. A staple 22 is driven through flange 19 to hold flange 19 in position relative to the metal furring strip 2. A tongue 20 of an adjacent ceiling board holds a side of the ceiling board in position since the tongue 20 engages a groove in the adjacent ceiling board.

The ceiling boards are normally composed of a wood or mineral fiber and the staple will readily penetrate the flange 19. The staple 22 also penetrates the metal of top wall 12 and the ends of the staple pass into the hollow area between wall 12 and ceiling 14 and the side walls 8 and 10 of the metal furring strip 2. The staple is basically a conventional ½" staple which is sold for use with the standard hand tacker stapler (Bostitch, Arrow, etc.). The staplers are readily available at any hardward store and are normally in the possession of many homeowners. This type of staple should not be confused with the conventional Swingline paper stapler. The stapler to be used is a slightly heavier-duty stapler used to fasten ceiling boards in position, staple telephone wires into position, etc. Normally the conventional staplers are provided with a sharp point. It has been found that it is desirable to slightly blunt the sharp point of the staple so that the staple has a slight blunt point or a chisel point, as compared to the awl point which is normally provided with staples. The metal used for the furring strip ranges in thickness from 0.010" to 0.015". This is a light gauge sheet metal. A problem is encountered in attempting to drive staples through this light gauge sheet metal within 3" of either end of the furring strip. The end of the furring strip has its top wall 12 collapse without penetration of the staples into the top wall. Collapsing progresses as additional attempts are made to staple too close to a collapse portion. This problem is overcome by the invention herein. The invention consists of forming the furring strip with a support flange which strengthens the end of the furring strip and combining this with an integral splice detail. Each end of the furring strips are formed with projecting tabs. By bending down a portion of the top wall 12, a support flange is formed which in effect closes off the open end of the furring strip. Slots are cut in the flanges through which the projecting tabs are bent to make the splice. A slight taper in the tabs to match the slots lets the tabs be bent easily. The furring strips are formed with the same type joint configuration at each end.

Figure 2:
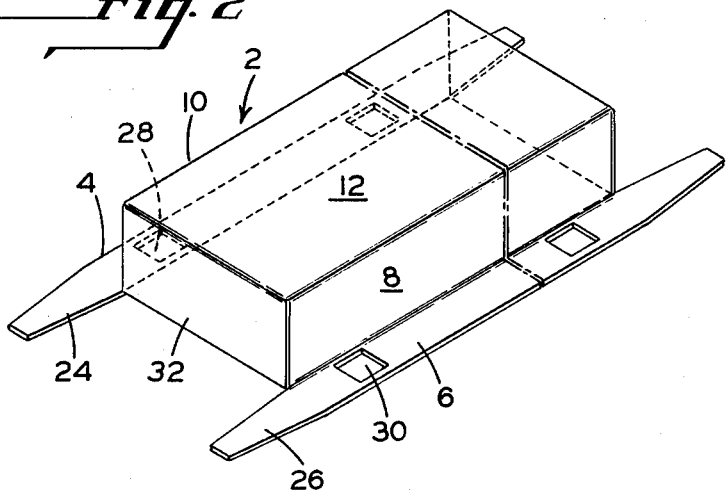
FIG. 2 is a perspective view of the furring strip with its inventive splice joint.

Referring now specifically to FIG. 2, there is shown the splice joint for the furring strip 2. The top wall 12 and the side walls 8 and 10 are shown. The flanges 4 and 6 are also shown. On the ends of the flanges 4 and 6, there are formed projecting tabs 24 and 26. These tabs are approximately $\frac{7}{8}$ inch long and are tapered on their ends. At the back of the projecting tabs there are formed slots 28 and 30. The same configuration is provided at both ends of the furring strip as shown in FIG. 2. In additon, a portion 32 of top wall 12 is bent down perpendicular to top wall 12 to form the support means 32. The support means 32 extends from top wall 12 to the plane containing flanges 4 and 6. Consequently, one pressing now on the center portion of top wall 12 adjacent support means 32 will find that the top wall will not sag under pressure such as would occur if support means 32 was not present. It is now possible to drive staples directly into the end of top wall 12.

Figure 3:
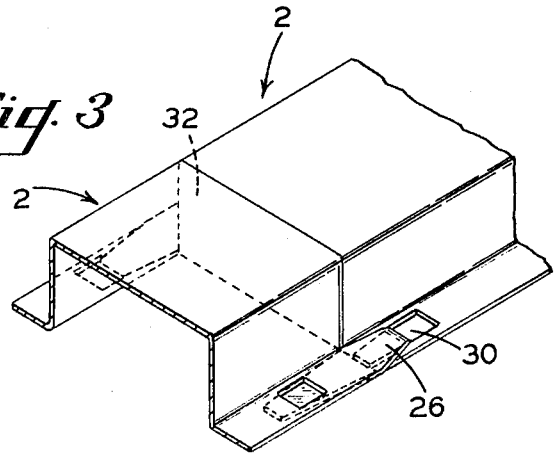
FIG. 3 is a perspective view of two metal furring strips connected together by the inventive spline joint.

Referring now to FIG. 3, there is shown two support runners 2 joined together. The support means 32 is shown in its dotted line position. A tab 26 is inserted into a slot 30 of the adjacent furring strip and the end of the tab 26 is bent around the edge of the slot 30 and pushed flat against the flange of the furring strip. This locks together one side of the furring strip. It is not necessary at this time to place the projecting tab of the flange of the adjacent furring strip into the slot behind projection 26. In effect, at the ends of two adjacent furring strips on each adjacent flange there will be two projecting tabs and two slots, one tab and slot per furring strip. Only the projecting tab of one furring strip need be positioned into the slot of the other furring strip and then bent around to lock the two elements together. However, at least one tab and slot arrangement must be engaged on the opposite flanges of two furring strips which are joined together. Consequently, in FIG. 3, there is shown one side of the furring strips locked together and the other side of the furring strips would be locked together in a similar manner, but this is not shown in the drawing of FIG. 3.

What is claimed is:

1. A furring strip with a splice end comprising:

(a) said furring strip being formed with a thin top wall section, (b) two side wall sections connected at their one side to the top wall section and extending from either side of the top wall section in a direction substantially perpendicular from the plane of the top wall section, (c) two flange members extending from opposite sides of the side wall sections substantially perpendicular therefrom and in a direction outwardly therefrom such that the plane of the flange members is spaced from the plane containing the top wall section and said top wall section and side wall sections form a hollow area therebetween, and (d) the improvement comprising tab means projecting outwardly from the end of each flange member and in the same plane as the flange members and slot means positioned in said flange members adjacent the point where the tab means extends from the flange members.

2. A furring strip as set forth in claim 1 wherein a support means is positioned perpendicular to the thin top wall section at the end thereof, said support means extends from the plane of the thin top wall section to the plane containing the two flange members, said support means being an integral part of the top wall bent down from the plane of the top wall to the plane of the two flange members and said tab means extends beyond the end of said flanges and said support means.

3. A suspended ceiling system composed of:

(a) a main ceiling structure, (b) a furring strip which has a top wall section spaced from the plane of the ceiling structure and fastened to the ceiling structure and forming a hollow area between the plane of the top wall section and the plane of the ceiling structure, (c) ceiling boards positioned up against the top wall section of the furring strip, (d) said ceiling boards being fastened to said furring strip by staple means which pass through the ceiling boards and into and through the top wall section of the furring strips into the hollow area between the top wall section and the ceiling structure, and (e) the improvement comprising a support means positioned perpendicular to the thin top wall section at the end thereof, said support means extending from the plane of the thin top wall section to the plane of the ceiling structure, said support means being an integral part of the top wall bent down from the plane of the top wall to the plane of the ceiling structure.

4. A suspended ceiling system as set forth in claim 3 wherein there are at least two furring strips, and each furring strip has two side walls extending perpendicular from the top wall section and two flange members extending outwardly perpendicular to the side wall sections to provide flange members which are in a plane parallel to the top wall section, each said flange member having projecting tabs and slots therein, the projecting tab of one furring strip engaging the slot of an adjacent furring strip to lock together said two furring strips.

* * * * *